US006435642B1

(12) United States Patent
Jackson et al.

(10) Patent No.: US 6,435,642 B1
(45) **Date of Patent: *Aug. 20, 2002**

(54) APPARATUS AND METHOD FOR REAL-TIME MEASUREMENT OF DIGITAL PRINT QUALITY

(75) Inventors: Jerome E. Jackson, Newtown; Richard A. Malin, Westport; Kevin M. Minckler, East Haven; Brian Romansky, Monroe; Arthur Rubinstein, Norwalk; Edilberto I Salazar, Brookfield, all of CT (US)

(73) Assignee: Pitney Bowes Inc., Stamford, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/193,609

(22) Filed: Nov. 17, 1998

(51) Int. Cl.[7] ..... B41J 29/393
(52) U.S. Cl. ..... 347/19
(58) Field of Search ..... 347/19, 5, 3

(56) References Cited

U.S. PATENT DOCUMENTS

| | | | | |
|---|---|---|---|---|
| 3,763,356 A | * | 10/1973 | Berler | 235/61.12 |
| 4,241,406 A | | 12/1980 | Kennedy et al. | 364/518 |
| 4,648,048 A | | 3/1987 | Dorn et al. | 364/526 |
| 4,900,941 A | | 2/1990 | Barton et al. | 250/566 |
| 4,907,013 A | | 3/1990 | Hubbard et al. | 346/1.1 |
| 5,038,208 A | | 8/1991 | Ichikawa et al. | 358/75 IJ |
| 5,070,410 A | * | 12/1991 | Hadley | 347/3 |
| 5,128,691 A | | 7/1992 | Millet et al. | 346/1.1 |
| 5,224,421 A | | 7/1993 | Doherty | 101/211 |
| 5,289,208 A | | 2/1994 | Haselby | 346/140 R |
| 5,321,436 A | * | 6/1994 | Herbert | 347/19 |
| 5,473,351 A | | 12/1995 | Helterline et al. | 347/19 |
| 5,495,103 A | | 2/1996 | Utiger et al. | 250/222.1 |
| 5,587,728 A | | 12/1996 | Edgar | 347/19 |
| 5,596,353 A | | 1/1997 | Takada et al. | 347/19 |
| 5,650,804 A | | 7/1997 | Kawamura et al. | 347/19 |
| 5,671,059 A | * | 9/1997 | Vincent | 250/226 |
| 5,760,799 A | | 6/1998 | Tetsuya et al. | 347/14 |
| 5,764,251 A | | 6/1998 | Hashimoto et al. | 347/16 |
| 5,771,051 A | | 6/1998 | Guenther et al. | 347/19 |
| 5,781,204 A | | 7/1998 | Kanematsu et al. | 347/17 |
| 5,798,772 A | | 8/1998 | Tachihara et al. | 347/11 |
| 5,933,179 A | | 8/1999 | Fogle et al. | 347/188 |

FOREIGN PATENT DOCUMENTS

| | | | |
|---|---|---|---|
| EP | 0872354 A2 | 10/1994 | B41J/19/20 |
| EP | 0702334 A1 | 8/1995 | G07B/17/02 |
| EP | 0702335 A1 | 8/1995 | G07B/17/02 |
| EP | 0714777 B1 | 11/1995 | B41J/2/165 |
| EP | 0714777 A1 | 11/1995 | B41J/2/165 |
| EP | 0747224 A1 | 5/1996 | B41J/2/21 |

OTHER PUBLICATIONS

U.S. Patent Application 08/240,199, filed on May 9, 1994 in the names of Fogle, et al., entitled Method of Insuring Print Quality of a Thermal Printer.

* cited by examiner

*Primary Examiner*—John Barlow
*Assistant Examiner*—An H. Do
(74) *Attorney, Agent, or Firm*—George M. Macdonald; Angelo N. Chaclas

(57) ABSTRACT

Predetermined print control signals are provided to a digital printing mechanism that responds to the print control signals to print an image on a substrate. A reference signal is derived from said print control signals. The image is scanned to generate a post-print signal. The reference signal is compared with said post-print signal. If the reference signal and the post-print signal do not compare within predetermined standards, an output signal indicative of poor print quality is generated. The print mechanism can be incorporated into a postage metering system and the image can be a postal indicia. The postage meter is responsive to a signal generated as a function of the output signal to inhibit further printing of postal indicia. Prior to printing the image, a substrate upon which the image is to be printed is scanned to generate a reflectance signal, the reflectance signal being used to correct the post-print signal. The post-print signal can represent integration of reflectance over segments of the image, or can represent summation of scanned pixels over segments of the image.

38 Claims, 9 Drawing Sheets

FIG.3

| LOCATION \ TIME | TØ | T1 | T2 | T3 | T4 | T5 |
|---|---|---|---|---|---|---|
| **AT SENSOR 30 -**<br>• SEGMENT SCANNED<br>• PRE-PRINT SIGNAL GENERATED & DELAYED FOR TIME - T4 -T0 | SØ | S1 | S2 | S3 | S4 | S5 |
| **AT PATH 32-**<br>• UNPRINTED SEGMENT TRANSPORTED | SØ | S1 | S2 | S3 | S4 | |
| **AT PRINTHEAD 14-**<br>• SEGMENT PRINTED<br>• REFERENCE SIGNAL GENERATED & DELAYED FOR TIME - T4 -T2 | SØ | S1 | S2 | S3 | | |
| **AT PATH 36 -**<br>• PRINTED SEGMENT TRANSPORTED | SØ | S1 | S2 | | | |
| **AT SCANNER 38 -**<br>• PRINTED SEGMENT SCANNED<br>• POST-PRINT SIGNAL GENERATED<br>• DELAYED PRE-PRINT SIGNAL SUBTRACTED<br>• DIFFERENCE COMPARED<br>• COMPARISON OUTPUT TESTED | SØ | S1 | | | | |
| **AT PATH 40 -**<br>• PRINTED SEGMENT OUTPUT | SØ | | | | | |

APPARATUS AND METHOD FOR REAL-TIME MEASUREMENT OF DIGITAL PRINT QUALITY

CROSS REFERENCE TO RELATED APPLICATIONS

This application is related to the following co-pending applications filed on Nov. 17, 1998 and assigned to the assignee of this application: U.S. patent application Ser. No.: 09/193,610, entitled MAILING MACHINE INCLUDING INK JET PRINTING HAVING PRINT HEAD MALFUNCTION DETECTION; U.S. patent application Ser. No.: 09/193,708, entitled APPARATUS AND METHOD FOR REAL-TIME MEASUREMENT OF DIGITAL PRINT QUALITY; and U.S. patent application Ser. No.: 09/193,607, entitled APPARATUS AND METHOD FOR MONITORING OPERATION OF AN INK JET PRINTHEAD; all of which are specifically incorporated herein by reference.

BACKGROUND OF THE INVENTION

The subject invention relates to digital printing. (As used herein, the term "digital printing" refers to any form of printing wherein print control signals control a print mechanism to produce a matrix of pixels, i.e. picture elements, having two or more intensity values, to represent an image.) More particularly it relates to apparatus and methods for the real-time measurement of digital print quality.

Low cost, widely available digital printing technologies such as ink jet, bubble jet, and thermal transfer printing have enabled many new applications where dynamically varying information must be transmitted in printed form. Many of these applications rely upon a consistent level of print quality over time since the failure to capture the unique information on even a single document can have serious consequences.

A particular example of an application of digital printing where a consistent level of print quality is very important is the use of digital print mechanisms in postage meters and mailing machines (hereinafter sometimes postage metering systems). As is well known such devices print postal indicia on mailpieces as proof of the payment of postage. Upon payment to a proper authority such meters or machines are "charged" with a representation of an equivalent amount of funds. As postal indicia are printed the funds in the meter are debited accordingly until exhausted. Since postal services accept indicia printed by postage meters or mailing machines as conclusive proof of payment of the amount of postage indicated such devices are in effect machines for printing money. As a result postal services have imposed high standards both on the print quality of indicia produced by such machines, and on the design of the machines themselves to assure that the appropriate amount is debited from the amount charged into the machine for each indicia printed.

Low cost digital print technologies have greatly simplified and improved the design of postage meters and mailing machines in many respects. Prior postage meters and mailing machines relied upon impact printing techniques which required complicated and expensive mechanisms to print varying postage amounts, which can now be printed in a simple, conventional manner with digital print mechanisms. More importantly, digital print mechanisms can be easily programmed to print other information such as security codes or addressing or tracking information with the postal indicia to facilitate automated mail handling. However such low cost digital print mechanisms can not easily provide consistent print quality as their mechanisms tend to degrade over time as ink dries up, small print nozzles clog or one or more of a number of small, rapidly cycling print elements fails. Such failure can cause substantial losses to a mailer since a large number of mail pieces of substandard print quality may be rejected by a postal service after the cost of the postage has been debited from the pre-paid amount charged to the machine.

U.S. Pat. No. 4,907,013; to: Hubbard et al.; issued: Mar. 6, 1990 is believed to be the prior art closest to the subject invention and relates to circuitry for detecting failure of one or more nozzles in an ink jet printhead. In Hubbard et al. a line containing one dot printed by each nozzle in the printhead is scanned to detect the possible absence of a dot. The line can form either a test pattern run before the start of a printing operation or can be incorporated into the image to be printed.

U.S. Pat. No. 5,038,208; to; Ichikawa et al.; issued: Aug. 6, 1991 teaches an ink jet printer which stores the image forming characteristics of an ink jet printhead and which corrects the image forming signals in accordance with the stored characteristics to maintain uniform print density.

U.S. Pat. No. 5,126,691; to: Millet et al.; issued: Jul. 7, 1992 is similar to Hubbard et al. in that it teaches a method for monitoring print quality by the use of a specially printed control frame.

U.S. Pat. No. 5,321,436; to: Herbert; issued Jun. 14, 1994 teaches a postage meter in which the operation of an ink jet printhead is checked by printing a predetermined bar code and then scanning the bar code to determine if it was correctly printed.

U.S. Pat. No. 5,473,351; to: Heterline et al. teaches a method and apparatus for monitoring print density by measuring printed line width and modifying the energy of the pulses applied to each ink jet nozzle to correct the line width.

While perhaps suitable for their intended purpose the print quality monitoring and control techniques found in the prior art did not provide a simple and inexpensive way to monitor print quality in real-time. Hubbard and similar prior art require special test patterns and so lack the immediate ability to detect a failure of print quality and/or the flexibility to monitor arbitrary print images; while other techniques taught in the prior art require expensive apparatus for measuring line width or printhead characteristics together with complicated control of the printhead drive signals.

Thus it is an object of the invention to provide an improved apparatus and method for the prompt, real-time monitoring of print quality so that prompt corrective actions can be taken.

BRIEF SUMMARY OF THE INVENTION

The above object is achieved and the disadvantages of the prior art are overcome in accordance with the subject invention by means of a method and apparatus for monitoring print quality produced by a digital printing mechanism, wherein predetermined print control signals are provided to the digital printing mechanism, the printing mechanism responding to the print control signals to print an image on a substrate; a reference signal is derived from said print control signals; said image is scanned to generate a post-print signal; said reference signal is compared with said post-print signal; and if said reference signal and said post-print signal do not compare within predetermined standards, an output signal indicative of poor print quality is generated.

In accordance with one aspect of the subject invention the print mechanism is incorporated into a postage metering system and said image is a postal indicia.

In accordance with another aspect of the subject invention the postage meter is responsive to a signal generated as a function of the output signal to inhibit further printing of postal indicia.

In accordance with another aspect of the subject invention the comparison of the reference signal and the post-print signal is corrected to compensate for the reflectance of the substrate.

In accordance with another aspect of the subject invention, prior to printing the image, a substrate upon which the image is to be printed is scanned to generate a reflectance signal, the reflectance signal being used to correct the post-print signal.

In accordance with another aspect of the subject invention, a substrate upon which the image is to be printed has a uniform reflectance, and, prior to printing the segment, an overall reflectance signal for the substrate is determined, the overall reflectance signal being used to correct the post-print signal.

In accordance with another aspect of the subject invention, the post-print signal represents integration of reflectance over segments of the image. In accordance with another, related aspect of the subject invention, each of the segments comprises a plurality of pixels printed substantially concurrently by a printhead in the print mechanism.

In accordance with another aspect of the subject invention, the post-print signal represents summation of scanned pixels over segments of the image. In accordance with another, related aspect of the subject invention, each of the segments comprises a portion of the image printed by a separate, corresponding printhead comprised in the print mechanism. In accordance with another, related aspect of the subject invention each of the segments is scanned by a separate photosensor. In accordance with another, related aspect of the subject invention a plurality of the segments comprise a postal indicia.

It will be apparent to those skilled in the art that the above object is achieved and the disadvantages of the prior art are overcome by the subject invention. Other objects and advantages of the invention will be apparent from consideration of the detailed description set forth below and of the attached drawings.

BRIEF DESCRIPTION OF THE DRAWINGS

FIG. 3 is a timing chart of the operation of the system of FIG. 1 in printing and measuring the print quality of the image of FIG. 2.

DETAILED DESCRIPTION OF PREFERRED EMBODIMENTS OF THE INVENTION

Figure 1:
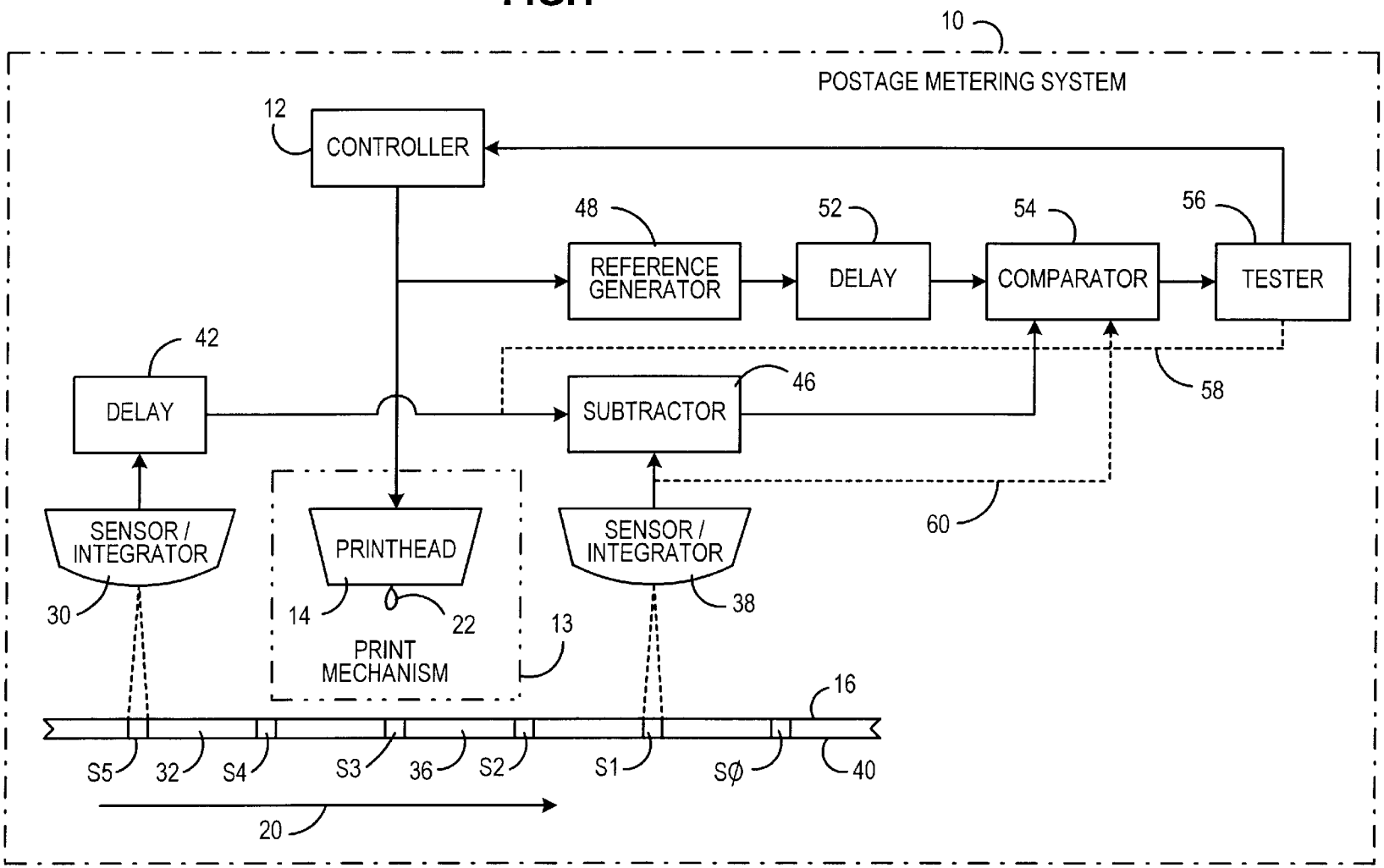
FIG. 1 is a schematic block diagram of a system including a digital printing mechanism and an apparatus for real-time monitoring of digital print quality.

FIG. 1 shows a digital printing system, which in preferred embodiment is postage metering system 10 which incorporates digital printing and which includes a conventional controller 12 for providing print control signals to a digital printing mechanism 13 in a conventional manner. (Metering operations of system 10 are conventional and need not be discussed further here for an understanding of the subject invention.) Preferably controller 12 is a microprocessor programmed to control print mechanism 13, which preferably includes ink jet printhead 14, in a manner well known to those skilled in the art. Printhead 14 forms an image in accordance with the control signals generated by controller 12 on substrate 16 as it moves past printhead 14 in the direction of arrow 20. As is well known in the art, printhead 14 comprises a row of nozzles (not shown) oriented transversely to arrow 20 and selected ones of these nozzles are activated by the print control signals generated by controller 12 to eject ink drops 22 onto substrate 16.

Figure 2:
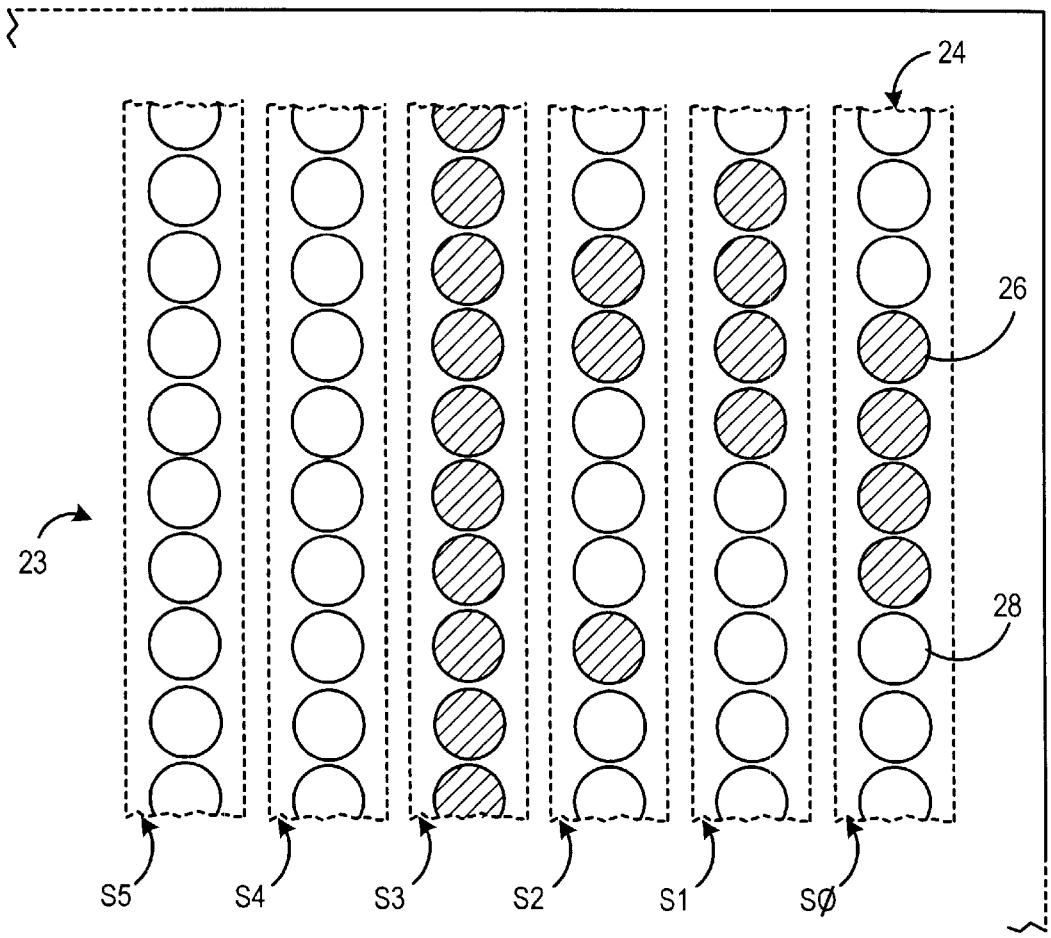
FIG.2 ( PRIOR ART)
FIG. 2 is a schematic representation, partly broken away, of a digital print image produced by the system of FIG. 1.

Turning to FIG. 2, schematic, partially broken away, image 23 is representative of a conventional image formed on substrate 16. Image 23 comprises a plurality segments, which in the preferred embodiment are successive vertical (i.e. transverse to the direction of motion of substrate 16) segments, including segments S0–S5 shown in FIG. 1. Each segment consists of a plurality of pixels 24, as shown with respect to segment S0, with each of pixels 24 corresponding to one nozzle of printhead 14. Each of pixels 24 can be either printed, as shown with respect to pixel 26, or unprinted, as shown with respect to pixel 28; accordingly as the print control signals generated by controller 12 activate, or do not activate, the corresponding nozzle of printhead 14 when that pixel is proximate to printhead 14. (Those skilled in the art will recognize that image 23 is not shown to scale and is intended only to illustrate the manner in which an image is formed by an ink jet print mechanism. Particularly they will recognize that, since horizontal resolution of digital images is typically approximately equal to the vertical resolution, an actual image will include many more segments then are shown in FIG. 2. Also, it should be noted that the length of the segments is not limited and can be made greater than the length of the row of nozzles in printhead 14 simply by mounting two or more printheads together and controlling them as a unit.)

Returning to FIG. 1, segment S5 is shown proximate to reflectance sensor/integrator 30 which scans unprinted segments as they are input to system 10 to generate a reflectance signal; segment S4 is shown being transported along path 32 between sensor/integrator 30 and printhead 14; segment S3 is shown proximate to printhead 14, where it is printed; segment S2 is shown being transported along path 36 between printhead 14 and sensor/integrator 38; segment S1 is shown proximate to sensor/integrator 38 which scans printed segments to generate a post-print signal; and segment S5 is shown being transported along path 40 as it is output.

System 10 also includes delay 42 which delays the reflectance signal so that it is synchronous with the post-print signal for the same segments; subtractor 46 which subtracts the delayed reflectance signal from the post-pint signal; reference generator 48 which processes the print control signals in accordance with a predetermined function to generate a nominal reference signal comparable with the post-print signal; delay 52 which delays the reference signal so that it is synchronous with the post-print signal for the same segment; comparator 54 which compares the reference signal and the difference between the post-print signal and the reflectance signal; and a tester which generates a poor print quality output signal if the results of the comparison exceed predetermined limits.

In other embodiments of the subject invention substrate 16 may have known, uniform reflectance characteristics (e.g. package label tapes which are commonly generated by mailing machines) and a predetermined reflectance signal can be used to correct the post-print signal, thus eliminating the need for a reflectance sensor.

Alternatively substrate 16 may have reflectance characteristics which are uniform over a particular item but which vary from item to item, so that each item of substrate 16 needs only single reflectance scan to establish an overall reflectance signal to correct the post-print scan. Those skilled in the art will recognize however that in general substrates will vary, particularly where substrate 16 includes pre-printed images, and the embodiment of FIG. 1 will be preferred.

In another embodiment of the subject invention, subtractor 46 can be eliminated and the output of delay 42 can be used to adjust the limits of tester 56, as shown by dotted lines 58 and 60 in FIG. 1.

Turning to FIG. 3, a more detailed description of the timing and operation system 10 is shown.

At time T0 segment S0 is proximate to sensor/integrator 30 which scans segment S0 to generate an integrated reflectance output signal representative of the overall reflectance characteristic of segment S0, which is delayed by delay 42 for a time equal to T4–T0. Various way in which the reflectance signal can be generated will be described more fully below in regard to description of various embodiments of the subject invention.

At time T1 Segment S0 is transported along path 32 to printhead 14 by any convenient transport mechanism (not shown) and segment S1 is at sensor/integrator 30.

At time T2 segment S0 is at printhead 14 where it is printed in accordance with print control signals generated by controller 12 in a conventional manner, segment S1 is transported along path 32 and segment S2 is proximate to sensor/integrator 30. Also at time T2 the print control signals are input to reference generator 48 which processes them in a predetermined manner to generate a reference signal which is comparable to the pre- and post-print signals. For example, in embodiments wherein the reflectance and post-print signals are representative of the integrated reflectance of a segment, as will be described more fully below, the reference signal can be generated by multiplying the fraction of unprinted pixels by a nominal reflectance per segment for substrate 16 and adding the product of a nominal reflectance for a fully printed segment times the fraction of printed pixels. In other embodiments described below, or which will be readily apparent to those skilled in the art, the reference signal can be generated in other appropriate manners so as to be comparable with the pre- and post-print signals. The reference signal is delayed by delay 52 for a time equal to T4–T2.

At time T3 segment S0 is transported along path 36 by any convenient transport mechanism (not shown), segment Si is proximate to printhead 14, segment S2 is transported along path 32 and segment S3 is proximate to sensor/integrator 30.

At time T4 segment S0 is proximate to sensor/integrator 38, segment S1 is transported along path 36 by any convenient transport mechanism (not shown), segment S2 is proximate to printhead 14, segment S3 is transported along path 32 and segment S4 is proximate to sensor/integrator 30. Sensor/integrator 38 scans segment S0, now printed, to generate an integrated signal representative of the overall reflectance of printed segment S0. It should be noted that it is an important feature of the system 10 that the pre- and post-print signals are comparable and it is preferred that sensor/integrators 30 and 38 be substantially identical. Also at time T4, the delayed reflectance signal output from delay 42 is subtracted from the post-print signal generated by sensor/integrator 38, and the resulting difference is compared with the delayed reference signal output by delay 52, and the comparison results are tested against predetermined limits by tester 56. If the comparison results exceed the limits tester 56 outputs a poor print quality signal.

Those skilled in the art will recognize many possible responses to a poor print quality signal. In embodiments where the print mechanism is comprised in a postage meter or mailing machine it is preferred that the system respond to poor print quality by disabling the capability to print postage until print quality is restored. Those skilled in the art will easily be able to determine criteria for disabling a system in view of the particular applications contemplated. The particular responses chosen to poor print quality signals do not form part of the subject invention considered in its broadest sense.

At time T5 segment S0 is transported along path 40 by any convenient transport mechanism (not shown) to exit system 10, segment S1 is proximate to sensor/integrator 38, segment S2 is transported along path 36, segment S3 is proximate to printhead 14, segment S4 is transported along path 32, and segment S5 is proximate to sensor/integrator 30.

Figure 4:
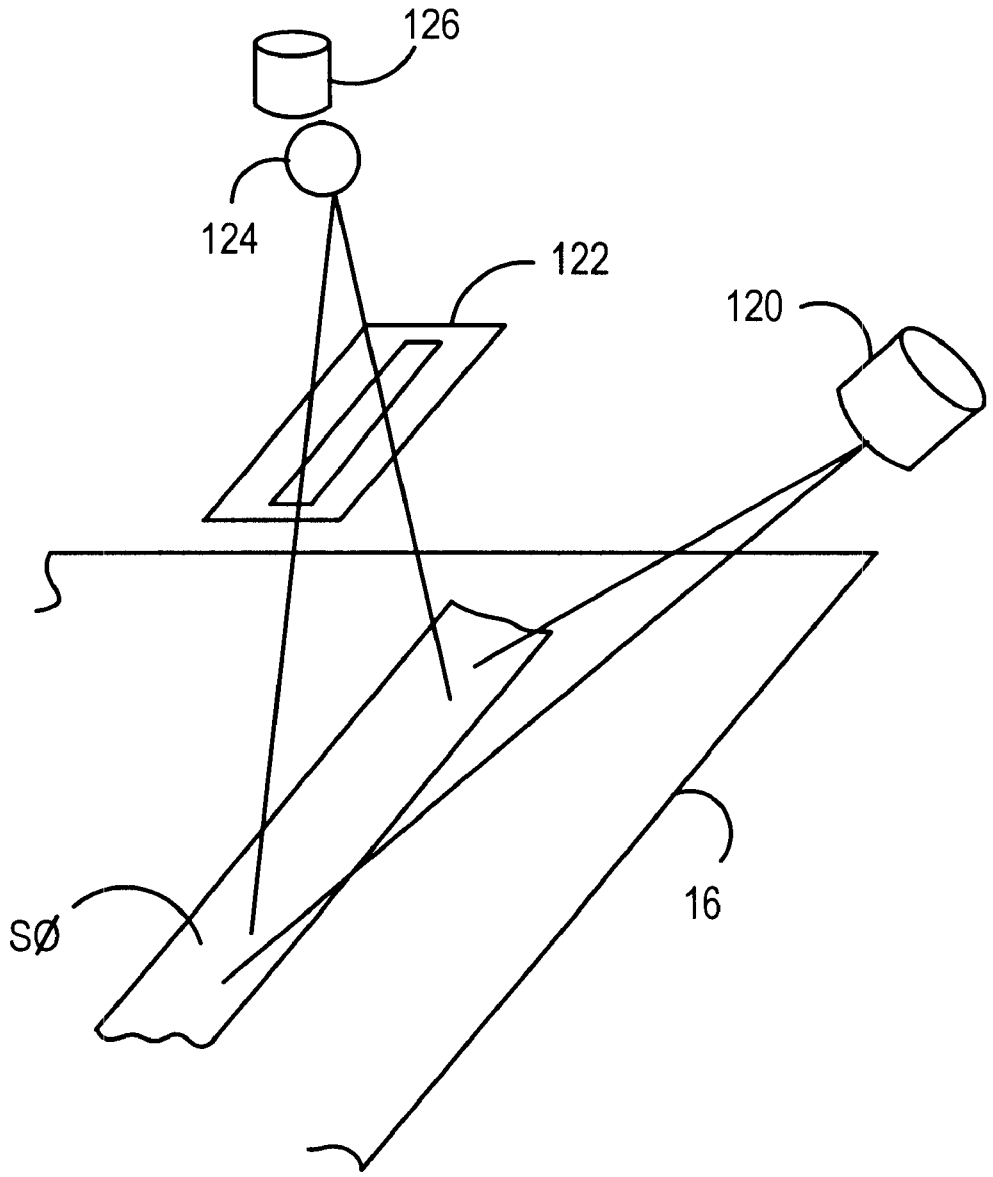
FIG. 4 is a schematic block diagram of a sensor for measuring reflectance of a segment of an image.

In FIG. 4 a sensor/integrator which can be incorporated into a system substantially similar to that of FIG. 1 in accordance with an embodiment of the subject invention. Light source 120, which can be of any convenient type, illuminates at least a part of substrate 16 which includes the segment being scanned, here shown as segment S0. Mask 122 masks light reflected from substrate 16 so that only light reflected from segment S0 is focused by lens 124 onto sensor 126. The output of sensor 126 is thus proportional to the integrated reflectance of segment S0.

Figure 5:
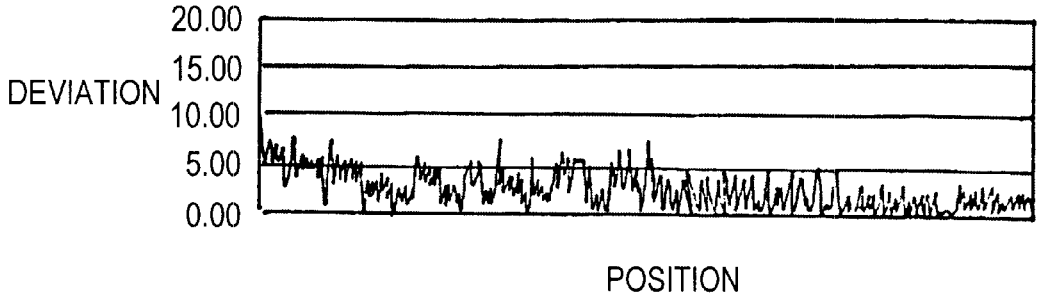
FIG. 5 shows the experimentally measured deviation of the reflectance of a good print quality image from reference values.
Figure 6:
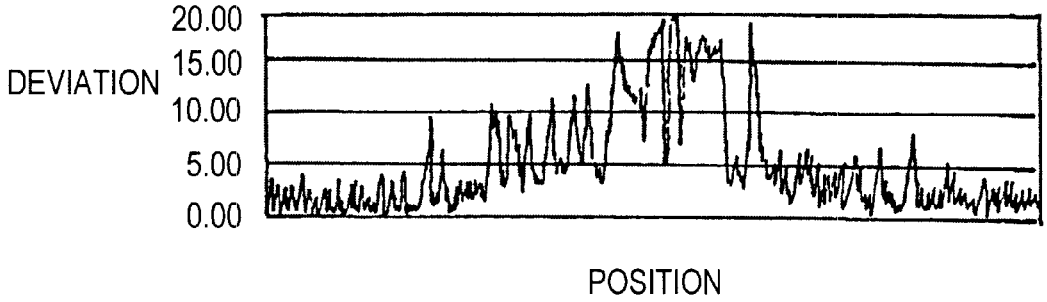
FIG. 6 shows the experimentally measured deviation of the reflectance of a poor print quality image from reference values.

FIGS. 5 and 6 show experimental results achieved using sensor/integrators as described with respect to FIG. 4 in substantially the manner of system 10, described above. Substrate 16 included pre-printed images (e.g. a "PLACE STAMP HERE" marking) within the image field. Reflectance and post-print signals were generated using sensor/integrators as shown in FIG. 4 and the resulting profiles of images stored. An ideal image profile for the same image was also created and stored. The reflectance profile was then subtracted from the post-print profile and the deviation of the resulting difference from the ideal image profile was computed as a function of position across the image. (In the above described experiments print quality problems were simulated. The images were printed on plain white paper using a laser printer which produced high-quality images. In order to create a "bad" sample the original print images were digitally altered.)

FIG. 5 shows the percentage deviation from the ideal profile as a function of horizontal position across the image for a high quality image. FIG. 6 shows the percentage deviation from the ideal profile as a function of horizontal position across the image for an image where defects in the print mechanism have resulted in low contrast and distortion of some parts of the image. Inspection of FIGS. 5 and 6 shows that the subject invention can discriminate between good and poor quality printing, in real-time, even in the presence of unknown variations in reflectivity of the substrate.

Figure 7A:
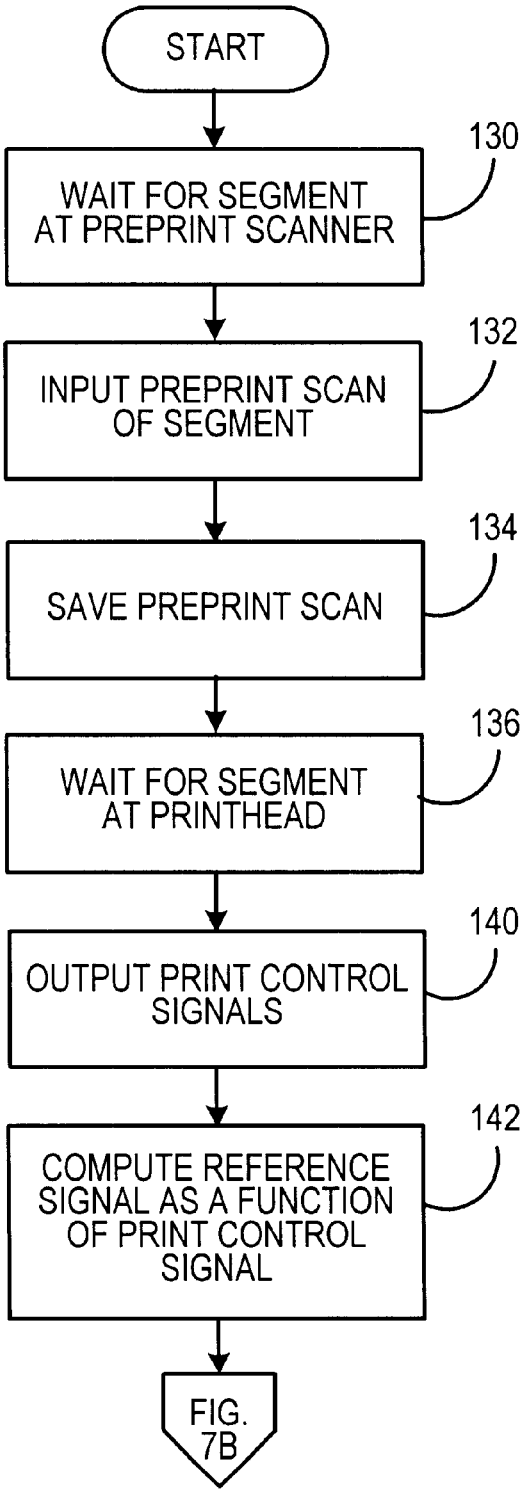
FIGS. 7A and 7B show a flow diagram of the determination of print quality in accordance with another embodiment of the subject invention.
Figure 7B:
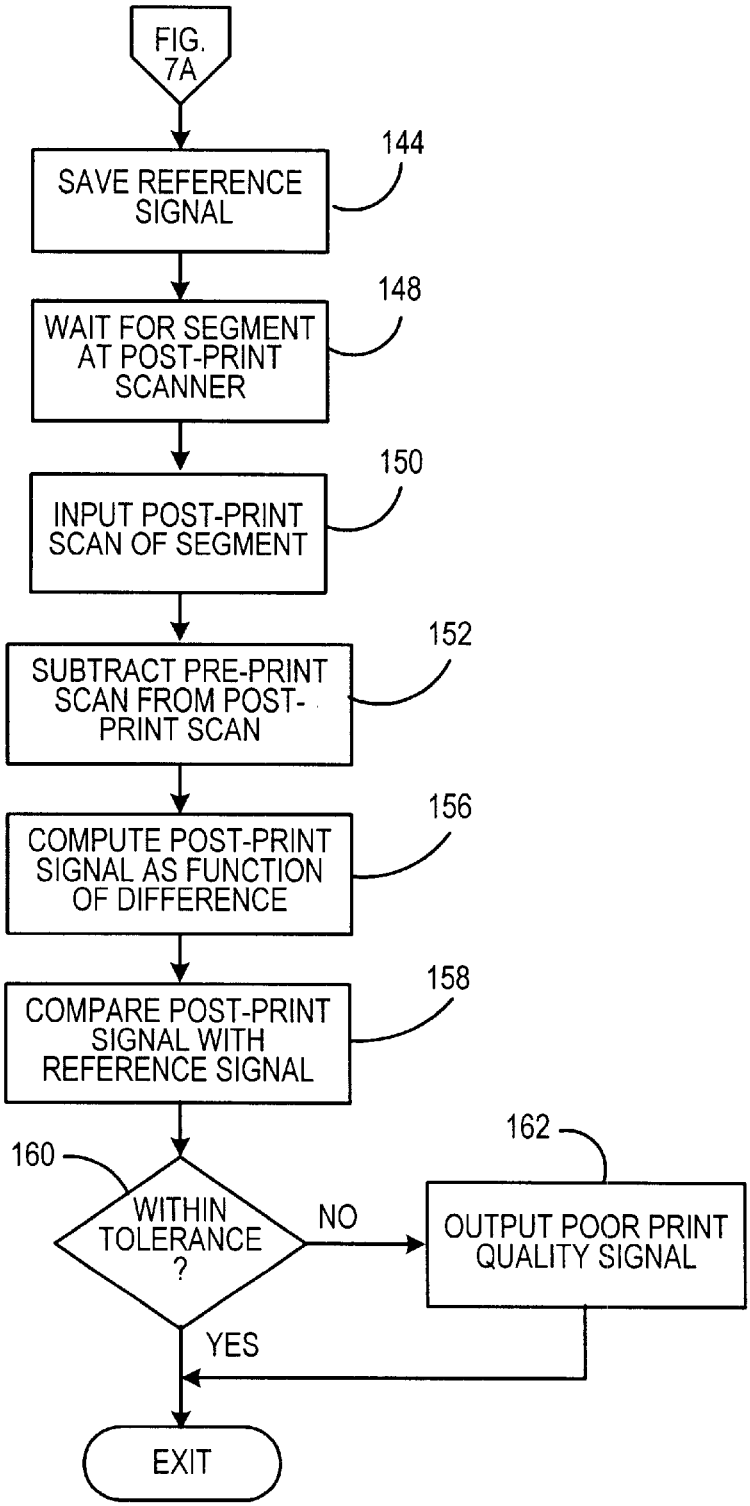

FIGS. 7A and 7B show a flow diagram of the operation of a data processing system in an embodiment of the subject invention wherein the method of the invention is carried out by a data processing system; which can be a print controller similar to controller 12 of system 10. In this embodiment unprinted and printed segments are scanned by conventional scanners to generate digital reflectance signals (pre-print scan) and post-print signals for processing in accordance with the subject invention.

At 130 the data processor waits for a segment to be proximate to the reflectance scanner. At 132 the data processor inputs the preprint scan, which is preferably a sequence of scanned pixels scaled as necessary to correspond to the print resolution. At 134 the data processor saves the reflectance scan, and, at 136 waits for the segment to reach the printhead. At 140 the data processor outputs print control signals to the printhead to print the segment. Then, at 142 the data processor computes a reference signal as a function of the print control signals. Preferably the reference signal is a summation of the printed pixels in the segment. At 144 the data processor saves the reference signal, and, at 148 waits for the segment to reach the post-print scanner. At 150 the data processor inputs the post-print scan, which is preferably a sequence of scanned pixels scaled as necessary to correspond to the print resolution. At 152 the reflectance scan is subtracted from the post-print scan. At 156 the data processor computes a post-print signal as a function of the difference. Preferably the post-print signal is a summation of the printed, scanned pixels remaining in the difference. At 158 the data processor compares the post-print signal with the reference signal, and, at 160, determines if the comparison results are within a predetermined tolerance. If not, at 162 the data processor outputs a poor print quality signal and exits. Otherwise the data processor exits from 160.

While the above description has been given with respect to processing of a single segment those skilled in the art will recognize that in preferred embodiments multiple instances of the above described code will execute concurrently to process multiple successive segments concurrently. Such concurrent programming is readily within the abilities of those skilled in and need not be described further here for an understanding of the subject invention the art.

As noted above, those skilled in the art will recognize that typical images will have a much higher horizontal resolution and will comprise a much higher segment density than described above. Accordingly, the above description will be understood to be given for simplicity of explanation and ease of understanding only; and can be easily adapted by those skilled in the art for use with conventional digital printing systems.

Figure 8:
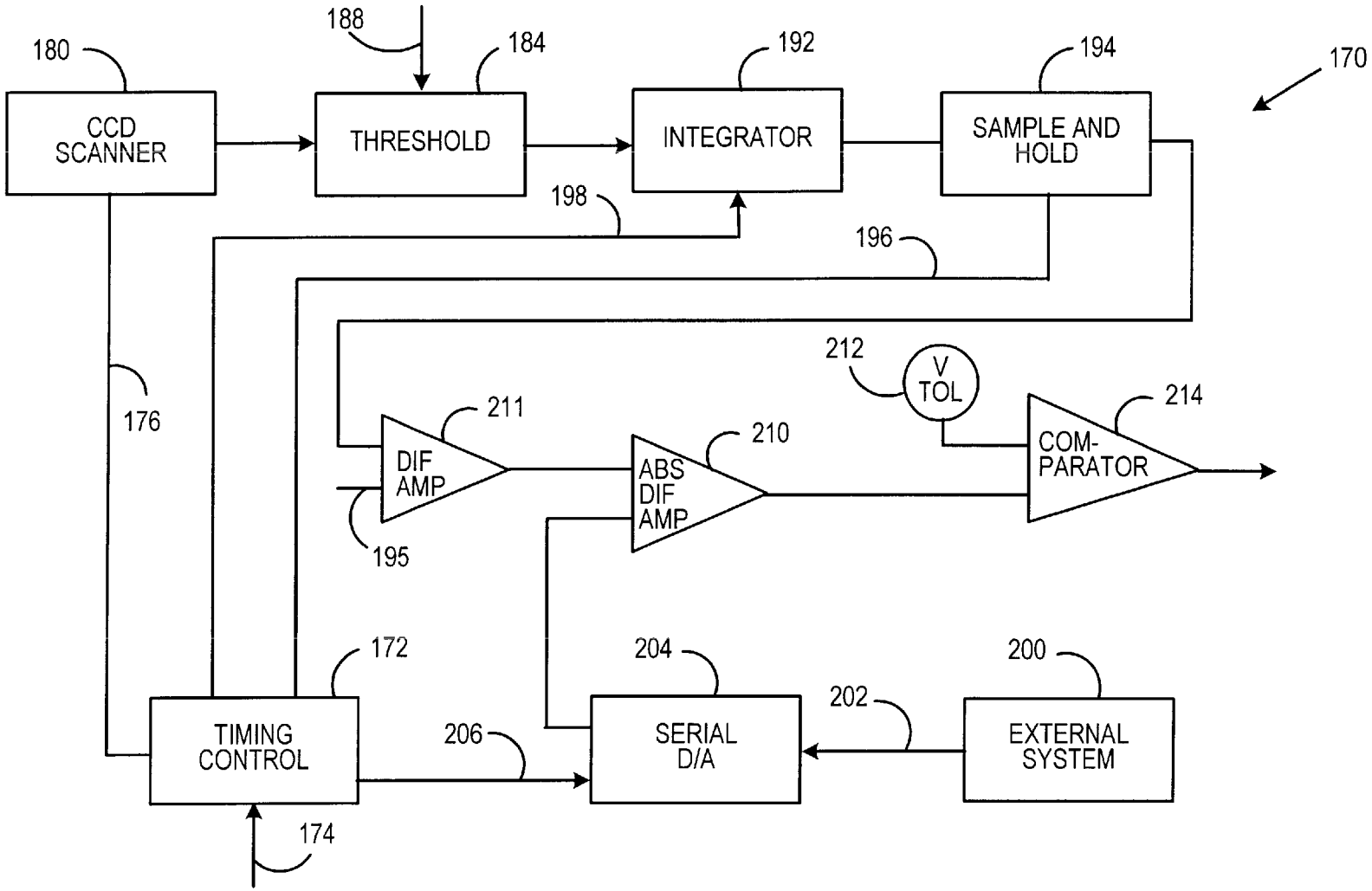
FIG. 8 is a schematic block diagram of an apparatus for determining print quality in accordance with one embodiment of the subject invention.

Turning to FIG. 8 circuit 170 is a an embodiment of the subject invention which includes a timing control circuit 172 which is synchronized with the operation of a conventional digital; printing system by synchronizing signals 174. Scan control signal 176 is generated by control circuit 172 when a segment to be scanned is proximate to CCD scanner 180. Preferably CCD scanner 180 is a conventional 256 by 1 scanner which scans a vertical segment of an image produced by an ink jet printer or similar digital printing system in substantially the same manner described above. As is well known in the art CCD scanner 80 records a 256 by 1 matrix, or other appropriate configuration congruent with the scanned segment, and sequentially outputs these sample as analog signal 182. In other embodiments other types of sensors may be used such as, for example, a linear or other type array of photo diodes.

Signal 182 is input to a black/white threshold 184 which outputs a sequence of binary pulses 190 whose value is determined accordingly as each of the samples in signal 182 exceeds or does not exceed threshold 188 (which is determined by the nominal black/white reflectance of the substrate). In the embodiment shown in FIG. 8 a second CCD scanner (not shown) scans the segment prior to printing (in substantially the same manner as the circuit of FIG. 8) to generate and store a threshold signal 95 corresponding to the integrated reflectance of the segment which is subtracted from the output of sample and hold 194 by differential amplifier 211, as will be described further below. In still other embodiments, where the reflectance of substrate 16 is constant, either generally or over particular items, threshold 188 may be accordingly constant. In other alternative embodiments where the reflectance of substrate 16 is sufficiently constant scanner 180 can be used to scan an unprinted part of substrate 16 at a convenient time (either before or after scanning the printed part) and the results stored for later comparison as described above.

Pulses 190 are then integrated by integrator 192 to generate an analog voltage proportional to the fraction of printed scanned pixels in the scanned image. (Those skilled in the art will recognize that the scanning and printing resolutions need not be the same and that appropriate scaling corrections should be made in generating a reference signal from the print control signals. It should also be noted that the scanned segment need not be congruent with printed segments though, since this greatly simplifies generation of reference signals, it is preferred.) Sample and hold circuit 194 is then strobed by timing signal 196 to store the output of integrator 192, which is then reset by timing signal 198.

External system 200, which is typically a printer controller, down loads a value to serial D/A which is proportional to the nominal fraction of printed pixels in the scanned portion of the image. Values are downloaded periodically, depending upon the rate and which the image varies. In postal applications, where the postal indicia image varies little within in a particular postal run, the value may be downloaded only at the beginning of a run. In other applications where the image to be printed varies more greatly, the value can be downloaded for each scanned image. The reference voltage output by D/A 204 and the difference between threshold signal 195 and the output of sample and hold 194 from differential amplifier 211 are then input to absolute difference amplifier 210 which generates an output proportional to the absolute difference between its inputs. The output of amplifier 210 is compared by comparator 214 with a voltage Vtol which defines the limit for the absolute difference signal. If this limit is exceeded a poor print quality signal is output. Limit Vtol is preferably determined by routine experimentation for various combinations of inks and substrates.

Threshold signal 195, can be generated by a separate CCD scanner, or scanner 180 can be used to scan an unprinted, representative portion of the substrate, as will be described further below.

In other embodiments the output of threshold 184 can be counted and compared digitally to the nominal fraction of printed pixels.

In still other embodiments of the subject invention the output of scanner 180, or other similar scanner, can be cross-correlated on a pixel by pixel basis so that problems with individual printhead nozzles can be identified.

Figure 9:
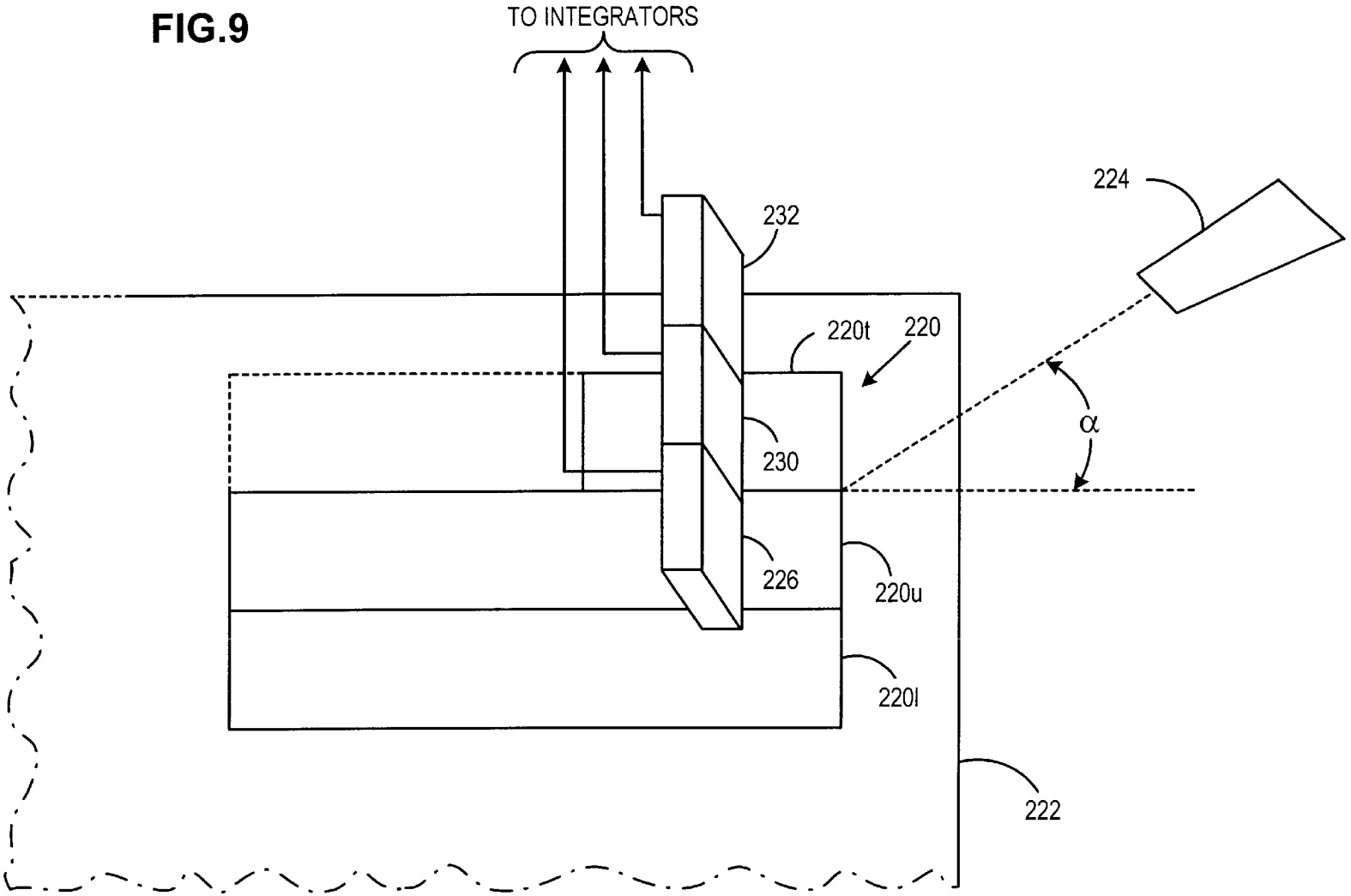
FIG. 9 is a schematic block diagram of a scanning array used in an embodiment of the subject invention for scanning indicia printed by multiple printheads.

FIG. 9 shows a schematic representation of a scanning configuration used in the application of a circuit similar to that of FIG. 8 to monitor print quality of postal indicia printed by ink jet printers or the like having multiple printheads. Indicia 220 comprises a postal indicia in accordance with applicable postal service regulations and can include advertising slogans, logos or similar additional information, and is printed on substrate 222 (e.g. an envelope) by an ink jet printer (not shown) in a conventional manner which need not be discussed further for an understanding of the invention.

Indicia 220 comprises 3horizontal bands: upper band 220*u* and lower band 220*l*, which are printed with black ink by upper and lower printheads (not shown) to print the postal indicia per se and tagger print 220*t*, which is printed by a third printhead (not shown) with fluorescent ink and is used to orient mail pieces for postal service facer canceler systems in a conventional manner.

Indicia 220 is illuminated by LED array 224 which preferably provides green light with a wave length of approximately 570 nanometers which was selected to provide maximal contrast for typical envelope stocks and postage meter inks. Array 224 is oriented at an angel alpha such that light is incident at an angel of approximately 45 degrees, while photodibde arrays 226,230 and 232 scan at an angel of approximately 90 degrees to pick up the diffuse reflectance rather than direct reflectance.

Photodiode array 226 is positioned to scan lower band 220*l*, array 230 to scan band 220*u*, and array 232 to scan band 220*t*. The photodiode arrays are arranged end-to-end transversely to the motion of indicia 220 and scan indicia 220 from top to bottom, with each array scanning 128 pixels in its corresponding band. Each scan requires approximately one millisecond so that, for typical indicia resolution of 240 DPI, lengths of about 3 inches and transport speeds of 40 inches/second there are about 75 scans on an indicia;

covering approximately 10% of the indicia. The integrated results for each band can then be compared with the nominal fraction of printed pixels for that band in a manner substantially similar to that described in regard to FIG. 4 above. If any band fails to compare correctly, a poor print quality signal is output.

As described above with reference to FIG. 8, some or all of scanners 226, 230 and 232, or one or more separate scanners can be used to generate a pre-print signal representative of the reflectance of substrate 222.

The embodiments described above and illustrated in the attached drawings have been given by way of example and illustration only. From the teachings of the present application those skilled in the art will readily recognize numerous other embodiments in accordance with the subject invention. Accordingly, limitations on the subject invention are to be found only in the claims set forth below.

What is claimed is:

1. A method for monitoring print quality produced by a digital printing mechanism, said method comprising the steps of:

a) providing predetermined print control signals to said digital printing mechanism, said printing mechanism responding to said print control signals to print an image on a substrate;

b) deriving a reference signal from said print control signals;

c) scanning said image to generate a post-print signal;

d) comparing said reference signal with a corrected version of said post-print signal accounting for a reflectance of said substrate, before said image is printed, corresponding to a location where said image is to be printed; and e) if said reference signal and said post-print signal do not compare within predetermined standards, generating an output signal indicative of poor print quality.

2. A method as described in claim 1 wherein said print mechanism is comprised in a postage metering system and said image is a postal indicia.

3. A method as described in claim 2 wherein said postage metering system is responsive to a signal generated as a function of said output signal to inhibit further printing of postal indicia.

4. A method as described in claim 1 comprising the further step of, prior to printing said image, scanning said substrate upon which said image is to be printed to generate a reflectance signal, said reflectance signal being used to correct said post-print signal.

5. A method as described in claim 1, wherein the reflectance of said substrate is uniform; and comprising the further step of, prior to printing said image determining an overall reflectance signal for said substrate, said overall reflectance signal being used to correct said post-print signal.

6. A method as described in claim 5 wherein said print mechanism is comprised in a postage metering system and said substrate is a tape.

7. A method as described in claim 1 wherein said post-print signal represents integration of reflectance over a plurality of segments of said image.

8. A method as described in claim 7 wherein each of said plurality of segments comprises a plurality of pixels printed substantially concurrently by a printhead comprised in said print mechanism.

9. A method as described in claim 1 wherein said post-print signal represents summation of scanned pixels over a plurality of segments of said image.

10. A method as described in claim 9 wherein each of said plurality of segments comprises a plurality of portions of said image, each of said portions printed by a separate corresponding printhead comprised in said print mechanism.

11. A method as described in claim 10 wherein each of said portions is scanned by a separate photosensor.

12. A method as described in claim 11 wherein the plurality of portions comprise a postal indicia.

13. A method as described in claim 12 wherein another plurality of portions of said image comprises a tagger print printed with a fluorescent ink.

14. A method as described in claim 9 wherein said summation is carried out digitally.

15. A method as described in claim 9 wherein said summation is carried out in analog form.

16. A method as described in claim 1 wherein said image comprises a vertical column of pixels.

17. A method as described in claim 1 wherein said image is scanned by reflected light from an LED source.

18. A method as described in claim 17 wherein said reflected light is diffuse.

19. A method as described in claim 18 wherein said reflected light is green light with a wave length of approximately 570 nanometers.

20. An apparatus for monitoring print quality produced by a digital printing mechanism, said apparatus comprising:

a) means for providing predetermined print control signals to said digital printing mechanism, said printing mechanism responding to said print control signals to print an image on a substrate;

b) means for deriving a reference signal from said print control signals;

c) means for scanning said image to generate a post-print signal;

d) means for comparing said reference signal with a corrected version of said post-print signal accounting for a reflectance of said substrate, before said image is printed, corresponding to a location where said image is to be printed; and e) means for generating an output signal indicative of poor print quality if said reference signal and said post-print signal do not compare within predetermined standards.

21. An apparatus as described in claim 20 wherein said print mechanism is comprised in a postage metering system and said image is a postal indicia.

22. An apparatus as described in claim 20 wherein said postage meter is responsive to a signal generated as a function of said output signal to inhibit further printing of postal indicia.

23. An apparatus as described in claim 20 further comprising means for, prior to printing said segment, scanning said segment to generate a reflectance signal, said reflectance signal being used to correct said post-print signal.

24. An apparatus as described in claim 20, wherein the reflectance of said substrate is uniform; and further comprising means for, prior to printing said image determining an overall reflectance signal for said substrate, said overall reflectance signal being used to correct said post-print signal.

25. An apparatus as described in claim 24, wherein said print mechanism is comprised in a postage metering system and said substrate is a tape.

26. A method as described in claim 20 wherein said post-print signal represents integration of reflectance over a plurality of segments of said image.

27. An apparatus as described in claim 26 wherein each of said plurality of segments comprises a plurality of pixels printed substantially concurrently by a printhead comprised in said print mechanism.

28. An apparatus as described in claim 20 wherein said post-print signal represents summation of scanned pixels over a plurality of segments of said image.

29. An apparatus as described in claim 28 wherein each of said plurality of segments comprises a plurality of portions of said image, each of said portions printed by a separate corresponding printhead comprised in said print mechanism.

30. An apparatus as described in claim 29 wherein each of said portions is scanned by a separate photosensor.

31. An apparatus as described in claim 30 wherein the plurality of portions comprise a postal indicia.

32. An apparatus as described in claim 31 wherein another plurality of portions of said image comprises a tagger print printed with a fluorescent ink.

33. An apparatus as described in claim 28 wherein said summation is carried out digitally.

34. An apparatus as described in claim 28 wherein said summation is carried out in analog form.

35. An apparatus as described in claim 20 wherein said image comprises a vertical column of pixels.

36. An apparatus as descibed in claim 20 wherein said image is scanned by reflected light from an LED source.

37. An apparatus as described in claim 36 wherein said reflected light is diffuse.

38. An apparatus as described in claim 37 wherein said reflected light is green light with a wave length of approximately 570 nanometers.

* * * * *